US009366120B2

(12) United States Patent
Merrill et al.

(10) Patent No.: US 9,366,120 B2
(45) Date of Patent: Jun. 14, 2016

(54) BLADDER STRESS REDUCER CAP

(71) Applicant: Baker Hughes Incorporated, Houston, TX (US)

(72) Inventors: Dan A. Merrill, Claremore, OK (US); Kelsey A. McKinney, Claremore, OK (US); Steven W. Pyron, Tulsa, OK (US); Jimmy J. Donnell, Bixby, OK (US); Kevin R. Bierig, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 219 days.

(21) Appl. No.: 14/158,540

(22) Filed: Jan. 17, 2014

(65) Prior Publication Data

US 2014/0202681 A1 Jul. 24, 2014

Related U.S. Application Data

(60) Provisional application No. 61/756,298, filed on Jan. 24, 2013.

(51) Int. Cl.

| | |
|---|---|
| ***E21B 43/12*** | (2006.01) |
| ***F04D 13/10*** | (2006.01) |
| ***F04D 29/08*** | (2006.01) |

(52) U.S. Cl.

CPC ..... *E21B 43/128* (2013.01); *F04D 13/10* (2013.01); *F04D 29/086* (2013.01)

(58) Field of Classification Search

USPC ..... 166/105; 277/635–637; 417/423.11, 417/424.1, 424.2

See application file for complete search history.

(56) References Cited

U.S. PATENT DOCUMENTS

| | | | | |
|---|---|---|---|---|
| 5,622,222 | A | 4/1997 | Wilson et al. | |
| 6,537,628 | B1 | 3/2003 | Bruewer et al. | |
| 6,851,935 | B2 | 2/2005 | Merrill et al. | |
| 7,520,735 | B2 | 4/2009 | Merrill et al. | |
| 7,530,391 | B2 | 5/2009 | Hall et al. | |
| 7,665,975 | B2 | 2/2010 | Parmeter et al. | |
| 7,708,534 | B2 | 5/2010 | Parmeter et al. | |
| 8,221,092 | B2 | 7/2012 | Chilcoat et al. | |
| 8,246,052 | B1 | 8/2012 | Marvel, III et al. | |
| 8,246,326 | B2 | 8/2012 | Royzen | |
| 2007/0140876 | A1* | 6/2007 | Parmeter ..... | F04D 13/10 417/423.11 |

* cited by examiner

*Primary Examiner* — Taras P Bemko
(74) *Attorney, Agent, or Firm* — Bracewell LLP

(57) ABSTRACT

A submersible pump assembly has modules, including a rotary pump, an electrical motor, and a seal section located between the motor and the pump. The seal section has a tubular housing with a lower adapter secured to the housing and joining the seal section with the motor. An upper adapter is secured to the housing and joins the seal section with another one of the modules. An inlet port in the upper adapter admits well fluid into the housing. A tubular, flexible compensator element has an upper end sealed to the upper adapter and a lower end sealed to the lower adapter. A communication passage in the lower adapter admits lubricant from the motor into the compensator element. A cap is mounted around the upper end of the compensator element. The cap has a skirt extending radially outward to limit upward expansion of the compensator element.

19 Claims, 4 Drawing Sheets

BLADDER STRESS REDUCER CAP

CROSS-REFERENCE TO RELATED APPLICATION

This application claims priority to provisional application 61/756,298, filed Jan. 24, 2013.

FIELD OF THE DISCLOSURE

This disclosure relates in general to electrical submersible well pumps and in particular to a cap located within a seal section adjacent a flexible compensator element to limit expansion of the compensator element in one direction.

BACKGROUND

Electrical submersible well pumps are commonly used for pumping well fluid from wells producing oil, water and possibly gas. A typical submersible pump assembly has a rotary pump driven by an electrical motor. A seal section locates between the motor and the pump. The seal section has a flexible compensator element that reduces a pressure differential between lubricant in the motor and the surrounding hydrostatic well fluid pressure. The compensator element may be a tubular elastomeric bag, with an interior in communication with motor lubricant and an exterior in communication with well fluid. The upper end of the bag is secured by a bag clamp to an adapter on the upper end of the seal section.

The motor lubricant will expand with temperature. At the typical depths, the well fluid in most wells will be at a higher temperature than the temperature of the air surrounding the wellhead. Also, when the motor begins to operate, the lubricant temperature increases. Consequently, the compensator element will normally expand from its initial state.

Seal sections have check valves to expel excess lubricant if the interior pressure becomes too much greater than the hydrostatic well fluid pressure. However, even if the check valves are pre-set to a relatively low differential pressure, there still may be enough pressure in the bags due to thermal lubricant expansion to expand the bags up and over the bag clamp. When the bags are expanded around the bag clamp, it causes excessive stress in the area where the edge of the clamp contacts the bag.

SUMMARY

The submersible pump assembly disclosed herein has a cap mounted around a first end of the compensator element. The cap has a skirt extending radially outward relative to an axis of the shaft to limit expansion of the compensator element in a first direction.

In the embodiment shown, the skirt of the cap is conical with a diameter increasing in a direction away from the first end of the compensator element. Also, the cap has a cylindrical neck. The skirt joins the neck and flares radially outward from the neck in a direction away from the first end. The skirt of the cap has an outer edge spaced radially inward from an inner sidewall of the seal section.

The first end of the compensator element comprises a cylindrical compensator neck. A conical compensator shoulder may join the compensator neck and extends in a direction away from the first end at a diverging angle. The cylindrical cap neck circumscribes the compensator neck. The skirt joins the cap neck and extends conically around the compensator shoulder and away from the first end at the same diverging angle. The cylindrical cap neck may be radially spaced from the compensator neck, defining an annulus between the cap neck and the compensator neck.

The seal section includes an adapter secured to a first end of the housing, the adapter having an axial passage through which the shaft extends. A tubular retainer is mounted in the axial passage and extends from the adapter in a direction away from the first end of the housing. The first end of the compensator element may be secured or clamped around the retainer. The cap may have a rim that is secured around the tubular retainer.

The skirt of the cap has a first side surface facing toward a first end of the seal section and a second side surface facing away from the first end of the seal section. A vent port may be in the cap to vent any trapped well fluid from the first side surface to the second side surface.

BRIEF DESCRIPTION OF THE DRAWINGS

The present technology will be better understood on reading the following detailed description of nonlimiting embodiments thereof, and on examining the accompanying drawings, in which.

DETAILED DESCRIPTION

Figure 1:
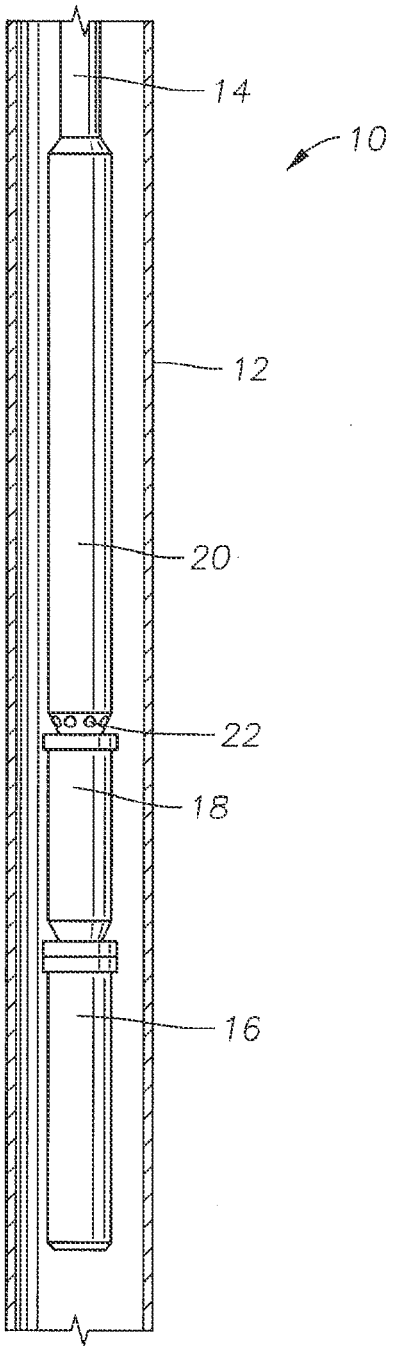
FIG. 1 is a side view of an electric submersible pump assembly (ESP) according to an embodiment of the present technology.

The foregoing aspects, features, and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. However, it is to be understood that the specific terminology is not limiting, and that each specific term includes equivalents that operate in a similar manner to accomplish a similar purpose.

Referring to FIG. 1, there is shown an electric submersible pump assembly 10 (ESP) installed within casing 12 in a well. ESP 10 is suspended on a string of tubing 14, and may discharge well fluid up tubing 14. ESP 10 has a plurality of modules, including a motor 16, which is connected to a seal section 18, which is in turn connected to a pump 20. Motor 16 is filled with a lubricant, and seal section 18 is configured to equalize the lubricant pressure with the hydrostatic pressure of the well fluid on the exterior. Pump 20 may be a rotary pump, such as a centrifugal pump or progressing cavity pump, and has an intake 22 on its lower end that draws well fluid into the pump 20. The ESP assembly 10 herein described is one possible embodiment of the present technology. For example, ESP assembly 10 could include other modules, such as a gas separator. If so, intake 22 would be in the gas separator rather than the pump 20.

Figure 2A:
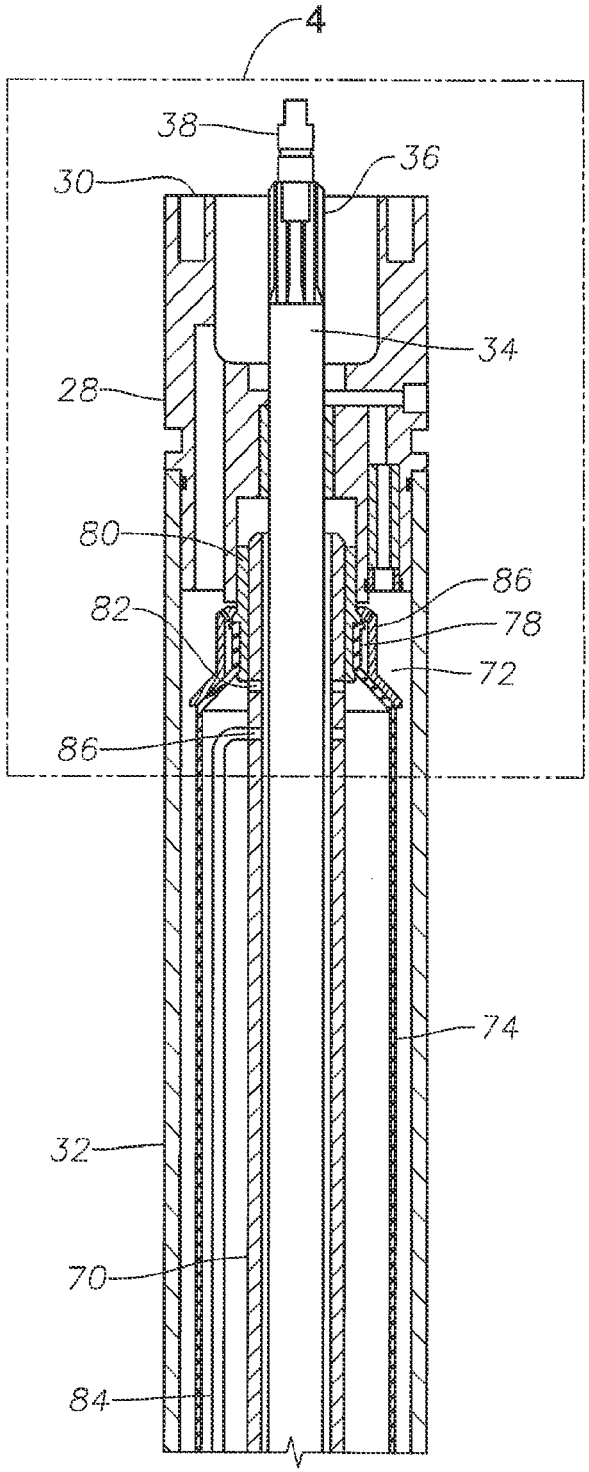
FIG. 2A is a side cross-sectional view of an upper portion of the sealing chamber of the ESP of FIG. 1.
Figure 2B:
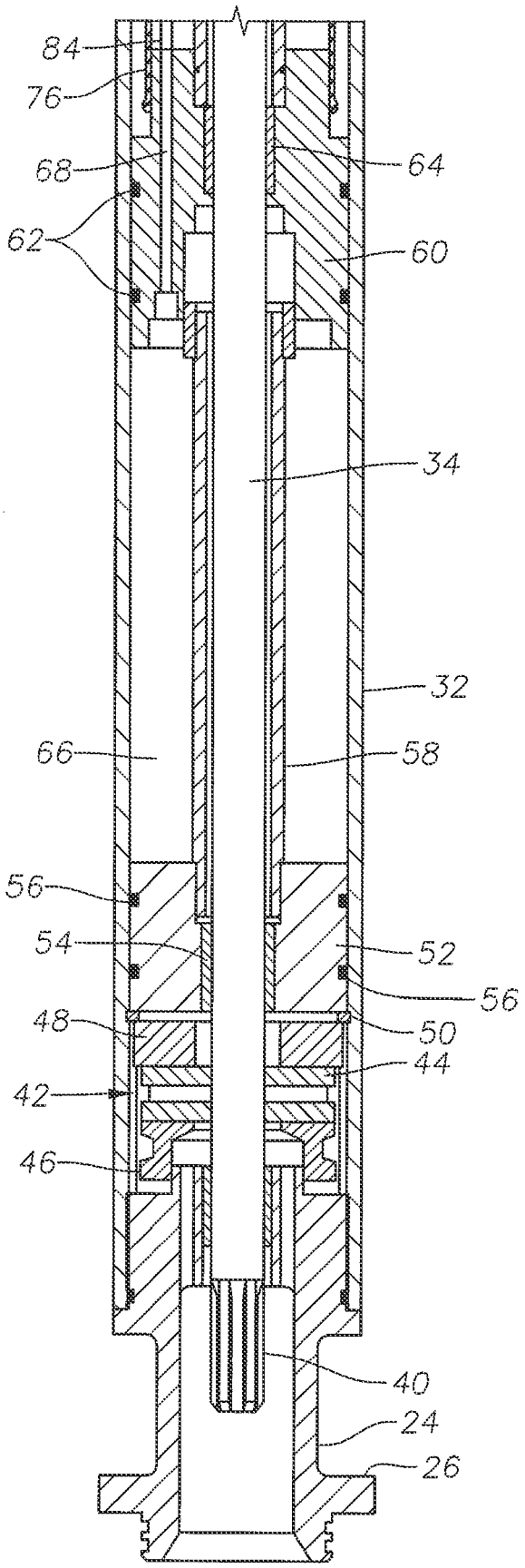
FIG. 2B is a side cross-sectional view of a lower portion of the sealing chamber of the ESP of FIG. 1.

Referring to FIGS. 2A and 2B, seal section 18 has a lower adapter 24 for securing to motor 16 (FIG. 1). Lower adapter 24 typically has a flange 26 that receives bolts that bolt to a mating flange of motor 16. An upper adapter 28 (FIG. 2A) connects seal section 18 to pump 20 (FIG. 1). Upper adapter 28 has threaded holes 30 for receiving bolts from a lower adapter of pump 20. Seal section 18 has a housing 32 that comprises a cylindrical sleeve secured to lower and upper adapters 24, 28. Housing 32 may be a single integral member.

A shaft 34 extends through seal section 18 for transmitting rotary motion from motor 16 to pump 20. Shaft 34 has an upper splined end 36 that optionally may have a latch member 38. Latch member 38 latches to the shaft (not shown) of pump 20 so as to transmit tension. Shaft 34 has lower splined end 40 that engages the shaft of motor 16 (not shown).

A conventional thrust bearing 42 is located in seal section 18, as illustrated in FIG. 2B. Thrust bearing 42 comprises a rotary thrust member or runner 44 that is secured to shaft 34. Runner 44 rotatably engages a stationary downthrust member or base 46 that is mounted to the upper side of lower adapter 24. Runner 44 also engages a stationary upthrust member 48 while in upthrust. Upthrust member 48 is supported within housing 32 against upward movement by a retainer ring 50, which may be a snap ring.

A lower radial bearing support 52 is supported in housing 32 against downward movement by retainer ring 50. Lower radial bearing support 52 has a bushing 54 that is slidingly engaged by shaft 34. Bushing 54 does not form a seal on shaft 34 and may have passages or channels through it to freely allow the passage of motor lubricant. Lower radial bearing support 52 has seals 56 on its exterior that sealingly engage the inner diameter of housing 32. A lower isolation tube 58 extends sealingly into a counterbore in lower radial bearing support 52 at the upper end of bushing 54. Lower isolation tube 58 has an inner diameter that is larger than the outer diameter of shaft 34, creating an annular passage for the flow of motor lubricant. Motor lubricant is free to flow between the area surrounding thrust bearing 42 and the annular clearance within lower isolation tube 58.

The upper end of lower isolation tube 58 extends into sealing engagement with a counterbore in a central radial bearing support 60. Central radial bearing support 60 has seals 62 on its exterior that seal against the inner diameter of housing 32. Central radial bearing support also has a bushing 64 that slidingly engages shaft 34 but does not seal against the flow of lubricant. A lower chamber 66 is defined by the annular space between radial bearing supports 52 and 60 and surrounding lower isolation tube 58. A passage 68 extends through central radial bearing support 60 from its lower end to its upper end.

Still referring to FIGS. 2A and 2B, an upper isolation tube 70 has its lower end sealingly engaged in a counterbore in central radial bearing support 60 above bushing 64. The upper end of upper isolation tube 70 extends to upper adapter 28, defining an annular upper chamber 72 within housing 32.

A tubular elastomeric compensator element, bag or bladder 74 is located within upper chamber 72. Bladder 74 has a lower end 76 that fits sealingly around an upper neck portion of central radial bearing support 60. Bladder 74 has a neck 78 on its upper end that is sealingly secured or clamped to a bladder retainer 80, as shown in FIG. 2A. Bladder retainer 80 is a tubular member that may be secured by threads to the upper end of upper isolation tube 70. Bladder retainer 80 has an upper portion that may sealingly engage a counterbore formed in the lower end of upper adapter 28. Bladder 74 has a cylindrical sidewall 79 in this example. A conical shoulder 81 joins bladder neck 78 with bladder cylindrical sidewall 79.

Figure 4:
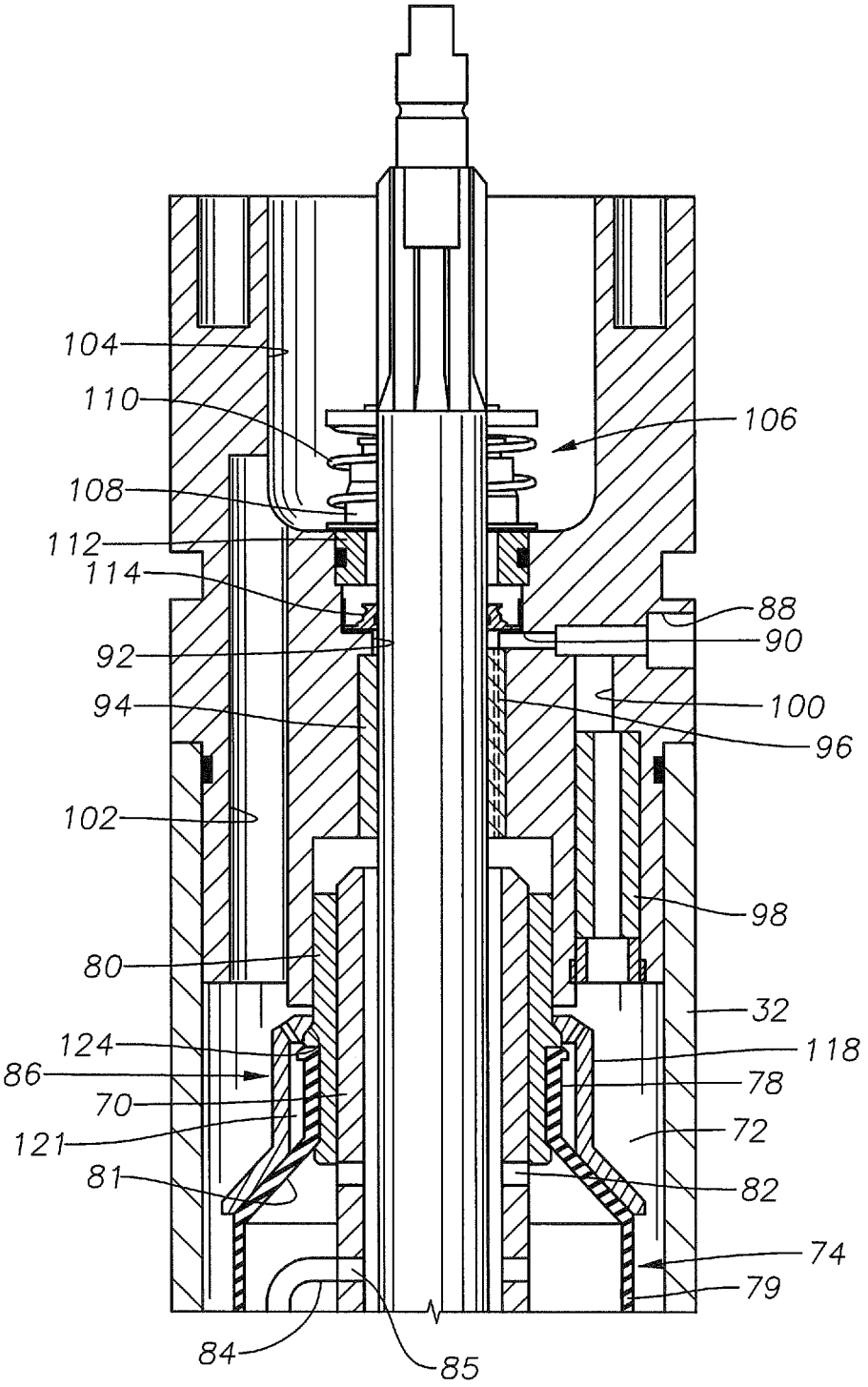
FIG. 4 is an enlarged cross-sectional view of the area identified as area 4 in FIG. 2A.

Referring to FIG. 4, there is shown a port 82 located in the sidewall of upper isolation tube 70 near its upper end. Port 82 communicates the annular clearance within upper isolation tube 70 with the interior of bladder 74, providing a communication passage for admitting motor lubricant to the interior of bladder 74. In addition, a labyrinth tube 84 has its upper end secured to a port 85 located adjacent port 82. Port 85 is shown below port 82, but it could be located at the same level or even above port 82. Labyrinth tube 84 is a small diameter tube that extends from port 85 downward alongside upper isolation tube 70 sealingly into the upper end of passage 68 (FIG. 2B) in central radial bearing support 60. Lubricant within lower chamber 66 can thus communicate with lubricant in the annular clearance around shaft 34 within isolation tubes 58 and 70 via labyrinth tube 84.

A bladder stress reducer cap 86 is positioned adjacent bladder retainer 80. Bladder stress reducer cap 86 is configured to prevent an upper end of the bladder 74 from extending upward toward upper adapter 28.

Referring to FIG. 4, a threaded plug receptacle 88 is located in upper adapter 28. Plug receptacle 88 will normally contain a plug (not shown) during operation, but it is removed during the lubricant filling procedure. A radially extending passage 90 joins an inner end of plug receptacle 88 and extends inward to an axial passage 92 through which shaft 34 extends. A bushing 94 is located within passage 92 for slidingly engaging and radially supporting shaft 34. Bushing 94 does not provide a seal against the flow of lubricant and may have flow passages through it as indicated by the dotted lines 96 in FIG. 4. One or more check valves 98 are located within a vent port 100 in upper adapter 28. Vent port 100 extends upward from the lower end of upper adapter 28 into an intersection with radial passage 90 inward from plug receptacle 88. Check valve 98 will allow downward flow of fluid into upper chamber 64 but not allow upward flow. A well fluid port 102 extends from the lower end of upper adapter 28 to a cavity 104 formed in the upper end of upper adapter 28. Cavity 104 is in fluid communication with well fluid on the exterior of seal section 18 via intake 22 (FIG. 1) of pump 20. Well fluid port 102 alternately could extend through an exterior sidewall of upper adapter 28.

A mechanical seal assembly 106 is located at the upper end of shaft 34 for sealing against the encroachment of well fluid from cavity 104 into motor 16 (FIG. 1). In this embodiment, mechanical seal assembly 106 includes a rotary seal member 108 that rotates with shaft 34 and is biased by a coiled spring 110 against a stationary seal base 112. A secondary shaft seal 114 may optionally be located below seal base 112. Secondary shaft seal 114 may optionally be a conventional shaft oil seal. A lubricant may be located between secondary shaft seal 114 and seal assembly 106, and that lubricant may differ from the motor lubricant.

Figure 3:
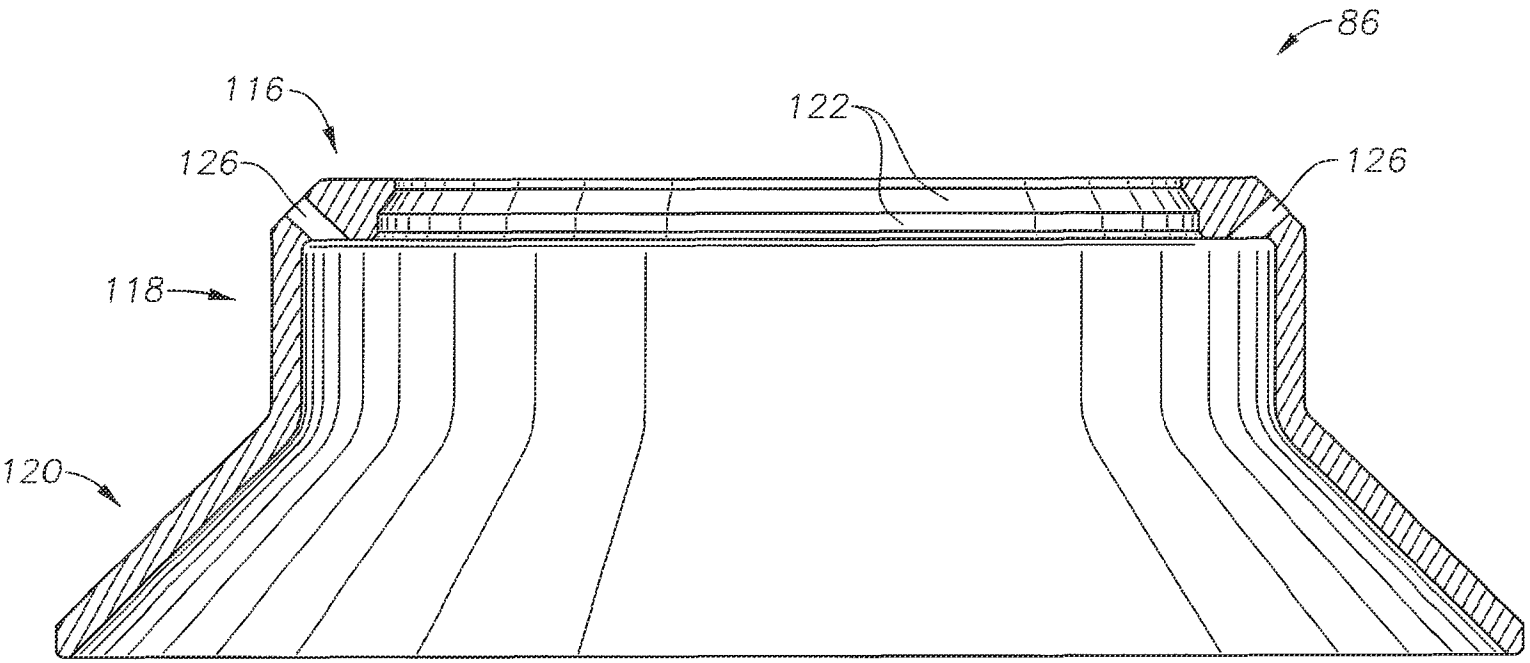
FIG. 3 is a side cross-sectional view of a bladder stress reducer cap according to an embodiment of the present technology.

As mentioned above, bladder stress reducer cap 86 is positioned adjacent the bladder retainer 80, and configured to prevent an upper end of the bladder 74 from extending upward toward the upper adapter 28. An enlarged view of the bladder stress reducer cap 86 is shown in FIG. 3. As shown, the bladder stress reducer cap 86 is a generally cup shaped member having an upper rim 116, a central neck 118, and a lower fluted, conical skirt 120. Cap 86 is a rigid member formed of a metal, composite, or hard plastic so that it will not deflect upward when bladder 74 expands upward. Cap 86 is on the exterior of bladder 74, thus during use, will be immersed in well fluid in seal section housing 32.

Skirt 120 flares outward in a downward direction and has an outer diameter less than an inner diameter of seal section housing 32 (FIG. 4). The outer diameter of skirt 120 is at least equal and preferably slightly greater than the outer diameter of bladder cylindrical portion 79, when bladder 74 is in a natural, unexpanded condition. The diverging angle of skirt 120 is the same as the diverging angle of bladder conical shoulder 81. Skirt 120 overlies and is in contact with bladder shoulder 81.

Cap neck 118 of the bladder stress reducer cap 86 connects cap rim 116 to the lower skirt 120, and spans the length of neck 78 at the upper end of bladder 74. In the embodiment shown, the inner diameter of cap neck 118 is greater than the outer diameter of bladder neck 78, creating an annulus 121 between them. Annulus 121 is in fluid communication with the well fluid in seal section housing 32. Annulus 121 may be advantageous because it allows for the use of the bladder stress reducer cap 86 with ESPs 10 having shafts 34 of different diameters, thereby making the bladder stress reducer cap 86 more universal and adaptable to ESPs 10 other than that specifically described herein.

In practice, rim 116 is configured to engage an outer surface of bladder retainer 80. This may be accomplished by any appropriate means. For example, in the embodiment of FIG. 3, rim 116 includes stepped ridges 122. These stepped ridges 122 generally correspond to a protrusion 124 on bladder retainer 80, so that when bladder stress reducer cap 86 is in place, stepped ridges 122 contact protrusion 124 of bladder retainer 80. In the embodiments shown, a portion of upper adapter 28 may extend toward bladder 74 until a bottom surface of upper adapter 28 is adjacent to bladder stress reducer cap 86, thereby restricting the ability of bladder stress reducer cap 86 from moving axially away from bladder 74.

Skirt 120 of bladder stress reducer cap 86 tapers radially outward from cap neck 118 toward the lower end of seal section 18. The junction between skirt 120 and cap neck 118 may be positioned adjacent the bottom of bladder neck 78 at the upper end of bladder 74. Skirt 120 is designed so that as bladder 74 expands, the top of bladder 74 is restrained by skirt 120 from extending upwardly around bladder retainer 80. One advantage to this is that bladder 74 will not expand around bladder retainer 80 and experience excessive stress in the area where the edge of bladder retainer 80 contacts bladder 74.

At least one vent 126 may extend through bladder stress reducer cap 86 to allow fluids to pass from above to below bladder stress reducer cap 86, and vice versa. One reason for such vents 126 is that as bladder 74 expands, it may seal against lower skirt 120 of bladder stress reducer cap 86 and trap well fluid. However, in most instances, a space will remain above such a seal, between neck 78 of the bladder 74 and cap neck 118 of bladder stress reducer cap 86. Provision of the vents 126 allows the pressure within this space to equalize with the pressure in the upper chamber 72, thereby preventing damage to bladder 74 or any other components.

During filling, lubricant flows upward through the spaces around thrust bearing 42 (FIG. 2B) and the annular clearance around shaft 34 in lower isolation tube 58. The lubricant flows up through the annular clearance in upper isolation tube 70 and down into bladder 74 via port 82 (FIG. 2A). Lubricant also flows into lower chamber 66 via labyrinth tube 84 and passage 68. Once lower chamber 66 and the interior of bladder 74 are filled, the lubricant will flow up into the spaces around shaft 34 in upper adapter 28, at least up to secondary shaft seal 114, if utilized.

After filling, a plug is installed in receptacle 88 and ESP 10 is lowered into the well. As ESP 10 is lowered into the well, well fluid enters upper chamber 72 via cavity 104 and passage 102. The hydrostatic pressure of the well fluid is exerted via bladder 74 to the lubricant within bladder 74 and motor 16. When at the desired depth, the operator supplies power to motor 16, causing pump 20 to draw well fluid in through intake 22 and discharge the well fluid through tubing 14 to the surface.

During operation, bladder 74 will tend to expand or contract depending on the relative pressures of the lubricant within bladder 74, and the fluids outside bladder 74. For example, in some instances the hydrostatic pressure of the fluids outside bladder 74 will be higher than the pressure of the lubricant within bladder 74, thereby causing the bladder to contract. However, during operation of motor 16, the lubricant within motor 16 and bladder 74 will heat. As the lubricant heats, it will expand, thereby expanding bladder 74. Because the bladder is elastomeric, it can expand or contract, thereby allowing the pressure of the lubricant to equalize with the pressure outside the bladder. Furthermore, as the bladder expands, it is restrained by bladder stress reducer cap 86 from expanding upwardly around bladder retainer 80, as described above.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology.

The invention claimed is:

1. A submersible pump assembly, comprising:
a rotary pump;
an electrical motor operatively coupled to the pump for driving the pump, the motor being filled with a motor lubricant;
a seal section located between the motor and the pump and comprising:
an inlet port to admit well fluid in the seal section, and a communication passage that admits the lubricant from the motor into the seal section;
a flexible compensator element located in the seal section and separating the lubricant from well fluid entering the seal section, the compensator element having a cylindrical side wall with a compensator neck of reduced diameter at a first end of the compensator element, defining a shoulder extending from the compensator neck to the cylindrical side wall relative to an axis of the shaft;
a tube extending through the compensator element;
a drive shaft for rotation by the motor extending through the tube;
a cap at the first end of the compensator element, the cap having a skirt extending radially outward and overlying the shoulder to limit expansion of the compensator element in a first direction; and wherein
the compensator neck is secured to the tube independently of the cap.

2. The assembly according to claim 1, wherein the skirt of the cap is conical with a diameter increasing in a direction away from the first end of the compensator element.

3. The assembly according to claim 1, wherein the cap further comprises:
a cylindrical cap neck; and wherein
the skirt joins the cap neck, extends around the compensator neck, and flares radially outward from the cap neck in a direction away from the first end of the compensator element.

4. The assembly according to claim 1, wherein the skirt of the cap has an outer edge spaced radially inward from an inner sidewall of the seal section.

5. The assembly according to claim 1, wherein:

the shoulder of the compensator element is conical and extends in a direction away from the first end of the compensator element at a diverging angle;

the cap has a cylindrical cap neck that circumscribes the compensator neck; and the skirt joins the cap neck and extends conically around the compensator shoulder and away from the first end of the compensator element at the diverging angle.

6. The assembly according to claim 1, wherein:

the cap has a cylindrical cap neck that circumscribes the compensator neck and is radially spaced from the compensator neck, defining an annulus between the cap neck and the compensator neck.

7. The assembly according to claim 1, wherein the seal section comprises:

a cylindrical housing;

an adapter secured to a first end of the housing, the adapter having an axial passage through which the shaft extends;

a tubular retainer mounted in the axial passage and extending from the adapter in a direction away from the first end of the housing; wherein the compensator neck is secured around the retainer; and the cap has a rim that is secured around the tubular retainer.

8. The assembly according to claim 1, wherein:

the skirt of the cap has a first side surface facing toward a first end of the seal section and a second side surface facing away from the first end of the seal section; and the cap has a vent port that vents any trapped well fluid from the first side surface to the second side surface.

9. The assembly according to claim 1, wherein:

the cap has a cup shaped portion; and the skirt joins the cup shaped portion and flares outward and away from the cup shaped portion in a direction away from the first end of the compensator element.

10. A submersible pump assembly, comprising:

a plurality of modules, including a rotary pump, an electrical motor, and a seal section located between the motor and the pump;

the seal section comprising:

a tubular housing;

a lower adapter secured to the housing and joining the seal section with the motor;

an upper adapter secured to the housing and joining the seal section with another one of the modules;

an inlet port in the upper adapter to admit well fluid into the housing;

a tubular, flexible compensator element having a cylindrical compensator neck on an upper end sealed to the upper adapter and a lower end sealed to the lower adapter;

a communication passage in the lower adapter that admits lubricant from the motor into the compensator element, the compensator element dividing the housing into a lubricant chamber and a well fluid chamber;

a drive shaft for rotation by the motor extending through the lower adapter, the compensator element, and the upper adapter; and a cap having a cylindrical cap neck mounted around the compensator neck in the well fluid chamber of the housing, the cap having a skirt extending radially outward relative to an axis of the shaft from the cap neck to limit upward expansion of the compensator element.

11. The assembly according to claim 10, wherein the skirt of the cap is conical with a diameter increasing in a downward direction.

12. The assembly according to claim 10, wherein:

the skirt flares radially outward from the neck in a downward direction; and the skirt has an outer edge spaced radially inward from an inner sidewall of the housing.

13. The assembly according to claim 10, wherein:

the compensator element has a cylindrical sidewall between the upper and lower ends;

a conical compensator shoulder joins the compensator neck with the sidewall of the compensator element; and the skirt is conical and extends around and above the compensator shoulder.

14. The assembly according to claim 10, wherein:

a tubular retainer is mounted to and extends downward from the upper adapter;

the compensator neck is secured around the retainer; and the cap has a rim that is secured around the retainer.

15. The assembly according to claim 10, wherein:

the skirt of the cap has an upper side and a lower side; and a vent port extends through the cap for venting any trapped well fluid on the lower side of the skirt to the upper side.

16. A submersible pump assembly, comprising:

a plurality of modules, including a rotary pump, an electrical motor, and a seal section located between the motor and the pump;

the seal section comprising:

a tubular housing;

a lower adapter secured to the housing and joining the seal section with the motor;

an upper adapter secured to the housing joining the seal section with another one of the modules;

an inlet port in the upper adapter to admit well fluid into the housing;

a tubular, flexible compensator element having an upper end sealed to the upper adapter and a lower end sealed to the lower adapter;

a communication passage in the lower adapter that admits lubricant from the motor into the compensator element, the compensator element dividing the housing into a lubricant chamber and a well fluid chamber;

a drive shaft for rotation by the motor extending through the lower adapter, the compensator element, and the upper adapter;

a cap mounted within the well fluid chamber around the upper end of the compensator element, the cap being cup-shaped and facing downward to limit upward expansion of the compensator element; wherein the upper end of the compensator element comprises a cylindrical neck and a conical shoulder extending downward from the neck at diverging angle; and the cap has a cylindrical neck, a skirt that is conical and extends downward from the neck of the cap at the same diverging angle, and overlies the conical shoulder of the compensator element.

17. The assembly according to claim 16, wherein:

the compensator element has a cylindrical sidewall between the upper and lower ends of the compensator element; and the cap has an outer diameter portion with an outer diameter at least equal to an outer diameter of the sidewall of the compensator element while the compensator element is in an unexpanded condition.

18. The assembly according to claim 16, wherein:

the compensator element has a cylindrical sidewall between the upper and lower ends of the compensator element;

the skirt has a lower edge with an outer diameter at least equal to an outer diameter of the sidewall of the compensator element; and the lower edge of the skirt is spaced radially inward from an inner sidewall surface of the housing.

19. The assembly according to claim 16, wherein:

the cap has an interior and an exterior; and a vent port extends from the interior to the exterior.

* * * * *